US007688244B2

(12) United States Patent
Lee et al.

(10) Patent No.: US 7,688,244 B2
(45) Date of Patent: Mar. 30, 2010

(54) REMOTE CONTROLLER CODE FORMAT(S), TRANSMITTING/RECEIVING APPARATUS THEREOF, AND TRANSMITTING/RECEIVING METHOD(S) THEREOF

(75) Inventors: Dong Ha Lee, Daegu (KR); Byung Gon Kim, Daegu (KR)

(73) Assignee: LG Electronics Inc., Seoul (KR)

( * ) Notice: Subject to any disclaimer, the term of this patent is extended or adjusted under 35 U.S.C. 154(b) by 1285 days.

(21) Appl. No.: 11/184,839

(22) Filed: Jul. 20, 2005

(65) Prior Publication Data

US 2006/0161812 A1 Jul. 20, 2006

(30) Foreign Application Priority Data

Jan. 20, 2005 (KR) ..... 10-2005-0005280

(51) Int. Cl.
*G08C 19/12* (2006.01)

(52) U.S. Cl. ..... 341/176; 340/825.69; 340/825.72; 348/734; 345/169

(58) Field of Classification Search ..... 340/825.69, 340/825.72; 341/176; 348/734; 345/169
See application file for complete search history.

(56) References Cited

U.S. PATENT DOCUMENTS

| | | | | |
|---|---|---|---|---|
| 4,932,037 | A * | 6/1990 | Simpson et al. | 375/147 |
| 5,182,551 | A | 1/1993 | Goto | 340/825.24 |
| 5,952,936 | A * | 9/1999 | Enomoto | 340/825.69 |
| 6,204,796 | B1 * | 3/2001 | Chan et al. | 341/176 |
| 2003/0117294 | A1 | 6/2003 | Hatano et al. | 340/825.72 |

FOREIGN PATENT DOCUMENTS

| | | |
|---|---|---|
| CN | 1423432 | 6/2003 |
| EP | 0825576 | 2/1998 |
| KR | 1999/051235 | 7/1999 |
| KR | 2004/103711 | 12/2004 |

OTHER PUBLICATIONS

Chinese Office Action dated Dec. 7, 2007.
European Search Report dated Sep. 5, 2007.
Korean Office Action dated May 12, 2006.

* cited by examiner

*Primary Examiner*—Timothy Edwards, Jr.
(74) *Attorney, Agent, or Firm*—KED & Associates, LLP

(57) ABSTRACT

Remote controller code format(s), transmitting/receiving apparatus thereof, and transmitting/receiving method(s) thereof are provided by which data can be transmitted/received using an intrinsic remote controller code format to prevent reciprocal compatibility with another remote controller of a different manufacturer. The remote controller code format(s) may include a header code, a custom code, a data code, an inverse data code, and an inverse custom code. One frame of the remote controller code format may be arranged in a sequence of the header code, the custom code, the data code, the inverse data code, the inverse custom code, and an end code. One frame of the remote controller code format may be arranged in a sequence of the header code, the custom code, the inverse custom code, the data code, the inverse data code, a check sum code, and an end code. Also, one frame of the remote controller code format may be arranged in a sequence of the header code, the custom code, the inverse custom code, the data code, the inverse data code, and an end code. A high pulse may have the same length as a low pulse in the header code.

18 Claims, 22 Drawing Sheets

REMOTE CONTROLLER CODE FORMAT(S), TRANSMITTING/RECEIVING APPARATUS THEREOF, AND TRANSMITTING/RECEIVING METHOD(S) THEREOF

This application claims the benefit of Korean Application No. P05-005280 filed Jan. 20, 2005, which is hereby incorporated by reference.

BACKGROUND OF THE INVENTION

1. Field of the Invention

The invention relates to a remote controller, and more particularly, to remote controller code format(s), transmitting/receiving apparatus thereof, and transmitting/receiving method(s) thereof.

2. Background of the Related Art

Generally, remote controllers for various industrial equipment and home appliances are used according to an automated and diversified society. A remote controller function means that a user can manipulate an operation of a receiver at a distance without paying a direct visit to the place where the receiver, which is capable of remote reception is installed, to manipulate the operation of the receiver. The remote controller function is a universal function employed by all receivers, such as TV, audio, video, air conditioner, etc.

The remote controller is generally provided as a set with each purchased receiver. Hence, a user is provided with various kinds of remote controllers, as many as the number of the receivers operated by the remote controllers, respectively. An infrared (IR) remote controller, which is used in general, has a binary code system differing according to manufacturer, product model, etc.

FIGS. 1A to 1C are diagrams of the binary code systems, in which various times and lengths of binary signals are shown. FIG. 1A shows a pulse coded signal system that is mainly used by SONY Corp. A length of a high pulse is varied to code information. In doing so, the length of a short high pulse becomes '0' and the length of a long high pulse becomes '1'.

FIG. 1B shows a space-coded signal system that is mainly used by Panasonic Corp. A length of a low pulse (i.e., space) is varied to code information. In doing so, the length of a short high pulse becomes '0' and the length of a long high pulse becomes '1'.

FIG. 1C shows a shift-coded signal system that is mainly used by Philips Corp. In coding information, '0' or '1' is indicated using a transition direction.

Remote controllers transmit a series of signals using the above systems. The signal can be divided into a header code part and a real code part. The header code is transferred to be used in activating a corresponding receiver before the real code is transferred. A header code part is always set uniform by the same manufacturer. The header code and real code keep being transmitted as long as a button of a remote controller is pressed.

A repetition time of the code is over approximately 50 msec. The code is divided into a part for sending an address and a part for sending a command. The address selects a receiving product and the command designates an operation.

Thus, each of the receivers is operated by means of the remote controller of its manufacturer. However, in the case of using a remote controller of a different manufacturer, instead of using the dedicated remote controller of a specific receiver to be operated by a user, the receiver generates an error, causing a malfunction or failure. Hence, in order to prevent the receiver from being operated by the remote controller of the different manufacturer, the dedicated remote controller of the receiver needs to have an intrinsic code format and the receiver should be capable of interpreting the intrinsic code format of the dedicated remote controller.

SUMMARY OF THE INVENTION

An object of the invention is to solve at least the above problems and/or disadvantages and to provide at least the advantages described hereinafter.

To achieve at least these objects and other advantages and in accordance with the purposes of the invention, as embodied and broadly described herein, there is provided in accordance with an embodiment of the invention a remote controller code format for a remote controller system including a remote controller and a receiver remotely controlled by the remote controller, the remote controller code format including a header code containing data for activation of the receiver to be controlled, a custom code containing data informing an address of the receiver to be controlled, an inverse custom code inverting the custom code, a data code containing data informing a value of the remote controller, and an inverse data code inverting the data code.

To further achieve at least these objects and other advantages and in accordance with the purposes of the invention, as embodied and broadly described herein, there is provided in accordance with an embodiment of the invention a remote controller system that includes a remote controller configured to store a plurality of remote controller code format modes therein, set up one of the stored plurality of remote controller code format modes as a transmission mode, generate a control signal according to the set up remote controller code format mode, and transmit the generated control signal, and a receiver configured to store information for the plurality of the remote controller code format modes therein and analyze the control signal transmitted from the remote controller according to the stored information.

To further achieve at least these objects and other advantages and in accordance with the purposes of the invention, as embodied and broadly described herein, there is provided in accordance with an embodiment of the invention a remote controller code format transmitting method for a remote controller system comprising a remote controller and a receiver remotely controlled by the remote controller, the method including setting up one of a plurality of remote controller code format modes, generating a control signal according to the set-up remote controller code format mode, and transmitting the generated control signal to the receiver to be controlled.

To further achieve at least these objects and other advantages and in accordance with the purposes of the invention, as embodied and broadly described herein, there is provided in accordance with an embodiment of the invention a remote controller code format receiving method for a remote controller system including a remote controller and a receiver remotely controlled by the remote controller, the method including receiving a control signal from the remote controller, checking whether the control signal is erroneous by analyzing the received control signal, and if the control signal is not erroneous, performing a corresponding function according to the analyzed control signal.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the written description and claims hereof as well as the appended drawings.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

Embodiments of the invention transmit/receive data using an intrinsic remote controller code format not compatible with remote controllers of different manufacturers and transmit/receive data by selecting of one of the various code formats. For example, a remote controller format structure according to embodiments of the invention may include a header code for activation of a receiver to be controlled, a custom code informing an address of the receiver to be controlled, an inverse custom code inverting the custom code, a data code informing a key value of a remote controller, and an inverse data code inverting the data code.

Figure 1A:
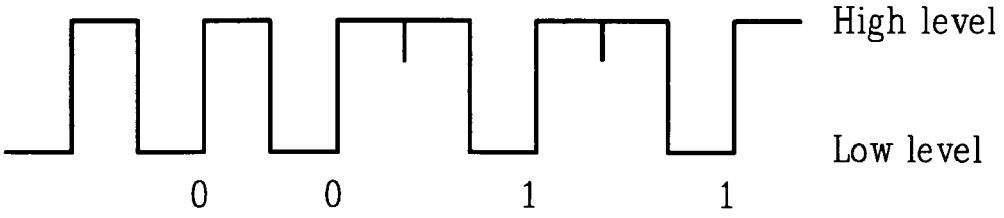
FIG. 1A Related Art
FIGS. 1A to 1C are diagrams of related art pulse coded signal systems.
Figure 1B:
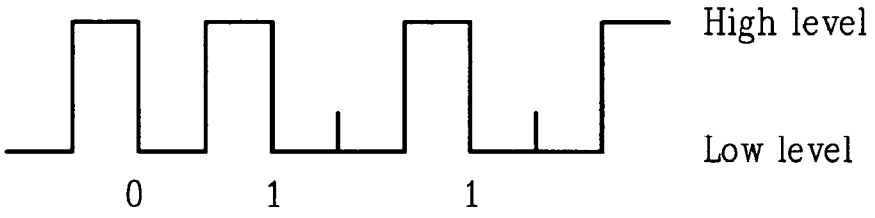
FIG. 1B Related Art
Figure 1C:
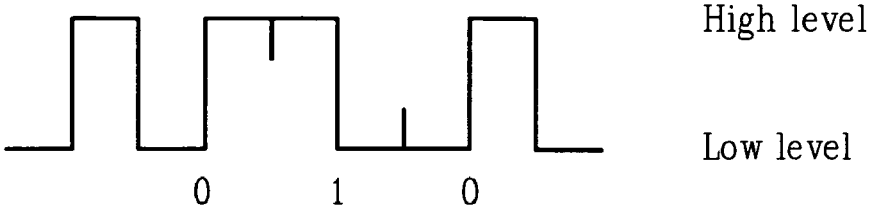
FIG. 1C Related Art
Figure 2A:
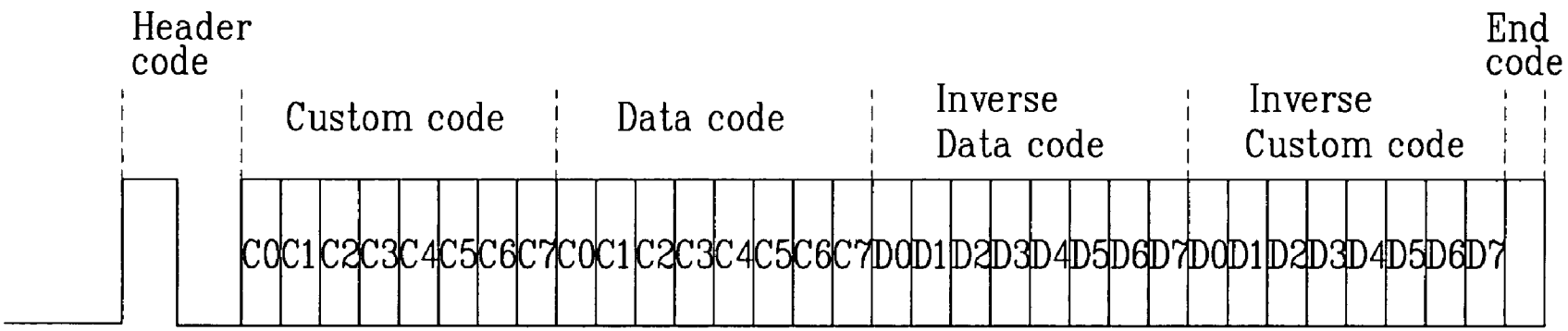
FIGS. 2A to 2D are diagrams of a remote controller code format structure according to an embodiment of the invention.

FIGS. 2A to 2D are diagrams of a remote controller code format structure according to an embodiment of the invention. FIG. 2A shows one frame of a remote controller code format. Referring to FIG. 2A, a header code, a custom code, a data code, an inverse data code, and an inverse custom code are sequentially arranged. 8-bits are allocated to each of the custom, data, inverse data, and inverse custom codes. An end code of 1-bit may further be arranged next to the inverse custom code.

Figure 2B:
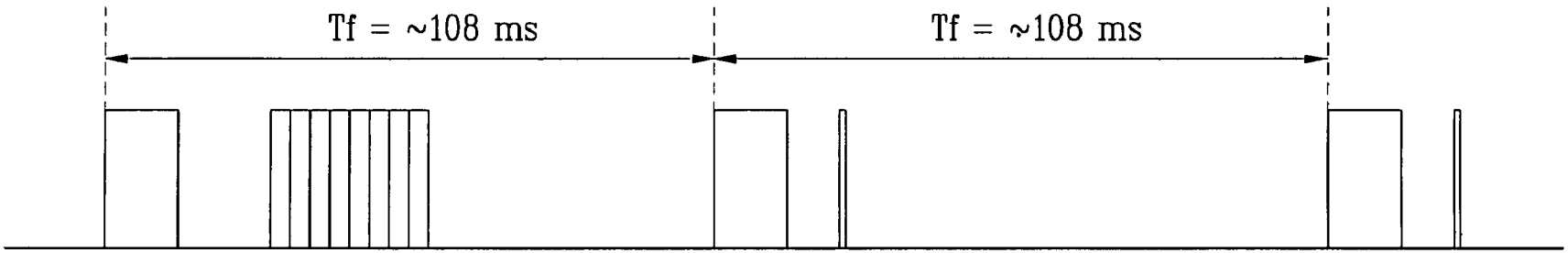

FIG. 2B shows a length ($T_f$) of one frame of the remote controller code format of FIG. 2A. Referring to FIG. 2B, in this embodiment a length of one frame is set up to ~108 ms.

Figure 2C:
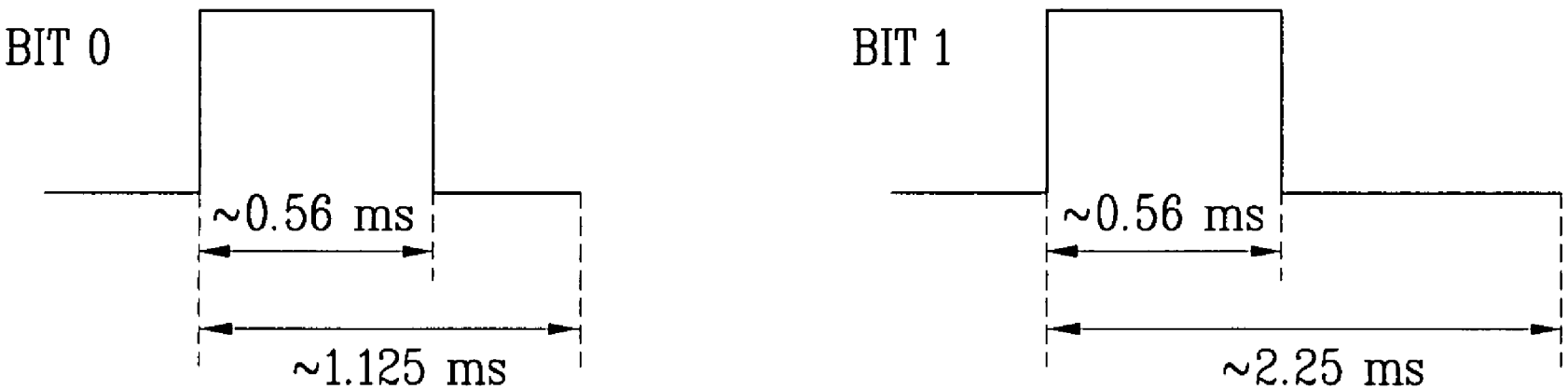

FIG. 2C shows a length of bit-0 and a length of bit-1. Referring to FIG. 2C, in this embodiment in bit-0, a length of a high pulse is set up to ~0.56 ms and a total length of high and low pulses is set up to ~1.125 ms. In bit-1, a length of a high pulse is set up to ~0.56 ms and a total length of high and low pulses is set up to ~2.25 ms.

Figure 2D:
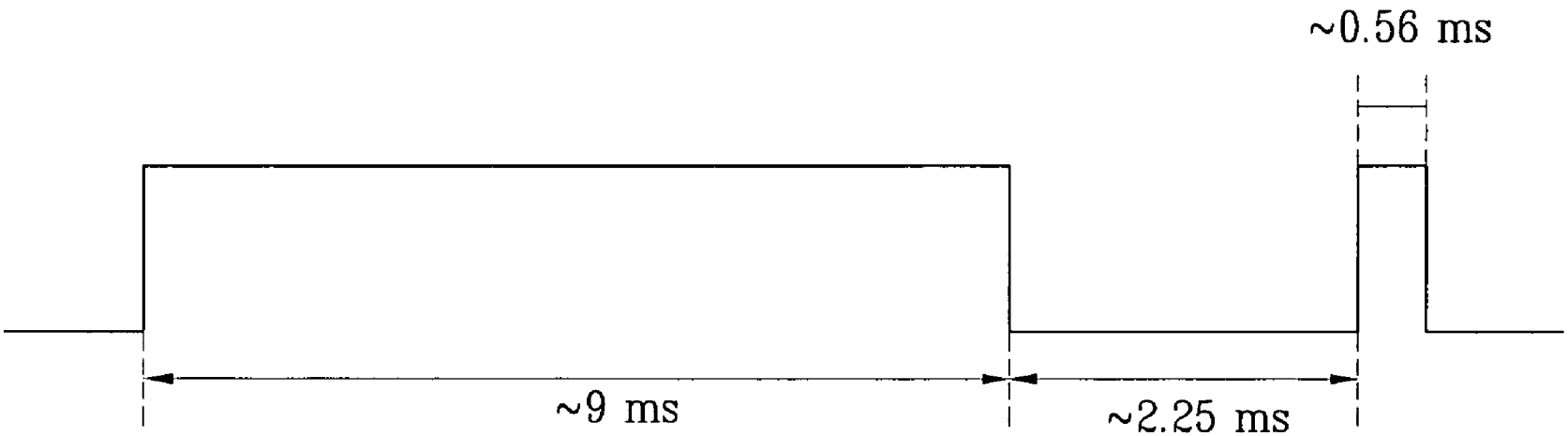

FIG. 2D shows a length of the header code of FIG. 2A. Referring to FIG. 2D, in this embodiment the header code includes a signal pulse of one cycle. A high pulse length is at least twice longer than a low pulse length. Further, in this embodiment, the high pulse length is set up to ~9 ms and the low pulse length is set up to ~2.25 ms.

Figure 3A:
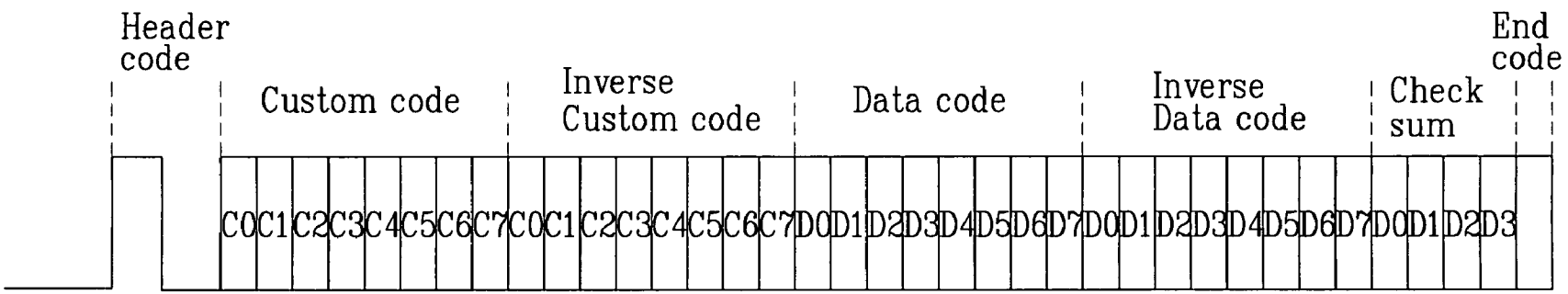
FIGS. 3A to 3D are diagrams of a remote controller code format structure according to another embodiment of the invention.

FIGS. 3A to 3D are diagrams of a remote controller code format structure according to another embodiment of the invention. FIG. 3A shows one frame of a remote controller code format. Referring to FIG. 3A, a header code, a custom code, an inverse custom code, a data code, and an inverse data code are sequentially arranged. A check sum code and an end code may be further arranged next to the inverse data code sequentially. In this embodiment, 8-bits are allocated to each of the custom, inverse custom, data, and inverse data codes, and 4-bits and 1-bit are allocated to the check sum code and the end code, respectively.

Figure 3B:
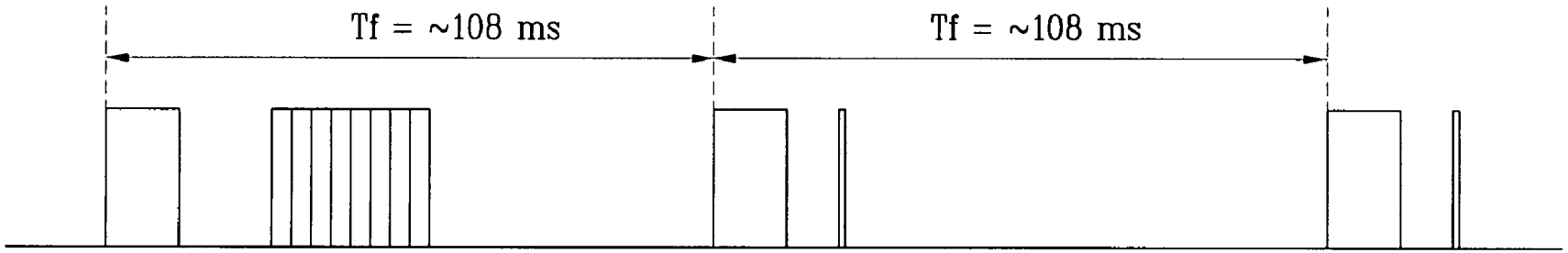

FIG. 3B shows a length ($T_f$) of one frame of the remote controller code format of FIG. 3A. Referring to FIG. 3B, in this embodiment a length of one frame is set up to ~108 ms.

Figure 3C:
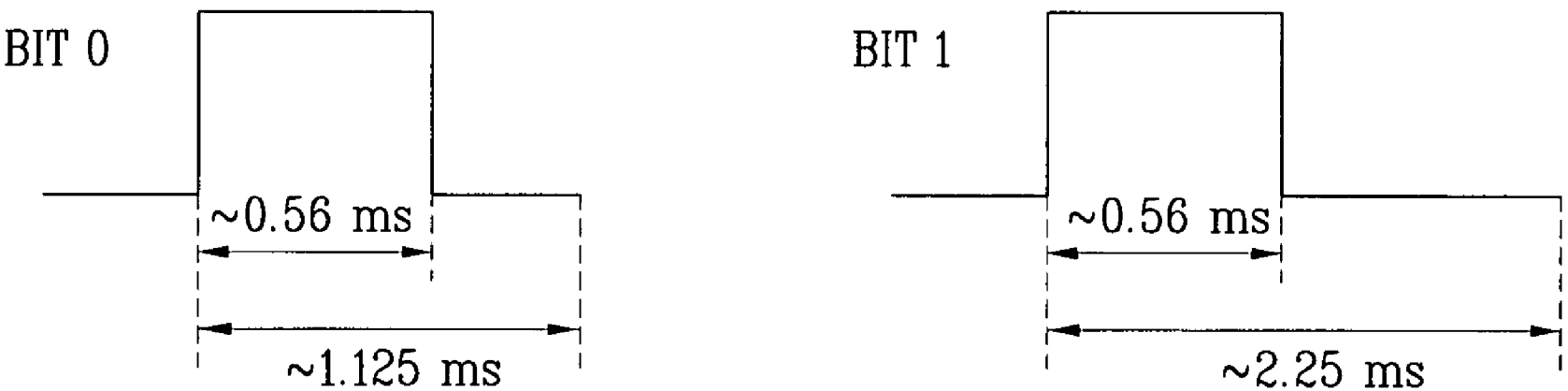

FIG. 3C shows a length of bit-0 and a length of bit-1. Referring to FIG. 3C, in this embodiment, in bit-0, a length of a high pulse is set up to ~0.56 ms and a total length of high and low pulses is set up to ~1.125 ms. In bit-1, a length of a high pulse is set up to ~0.56 ms and a total length of high and low pulses is set up to ~2.25 ms.

Figure 3D:
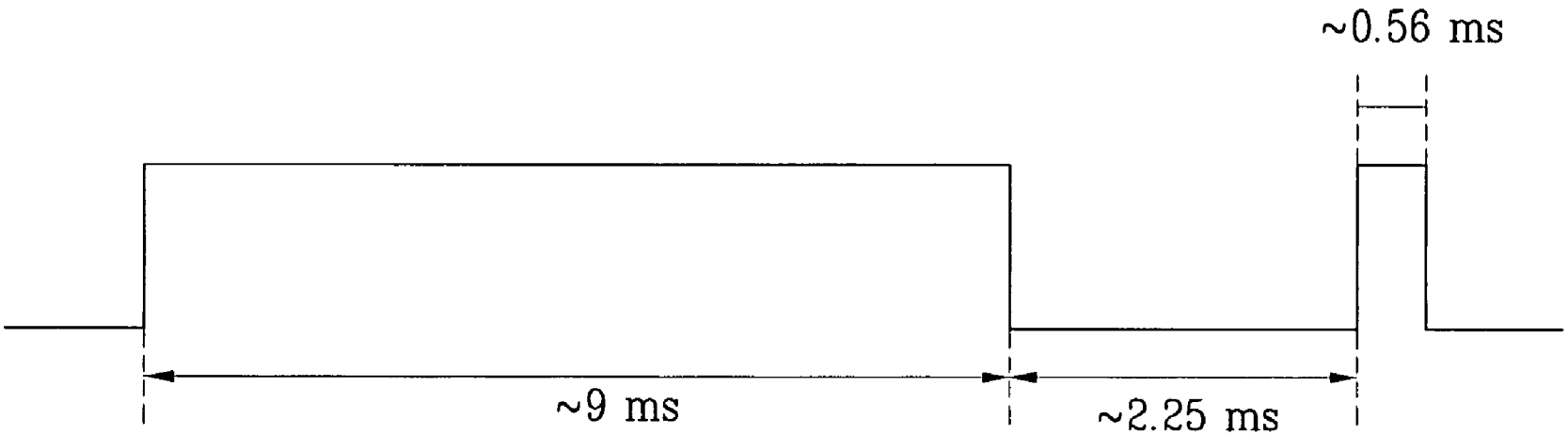

FIG. 3D shows a length of the header code of FIG. 3A. Referring to FIG. 3D, in this embodiment, the header code includes a signal pulse of one cycle. Further, a high pulse length is at least twice longer than a low pulse length. Also, in this embodiment, the high pulse length is set up to ~9 ms and the low pulse length is set up to ~2.25 ms.

The remote controller code format structure shown in FIGS. 3A-3D includes the check sum code. The check sum is calculated by dividing 8-bit data in a front part into upper 4-bits and lower 4-bits, which may be added. For instance, if a code is sent by 0x04+0xFB+0x05+0xFA, the calculation is executed in a following manner.

$$0+4+F+B+0+5+F+A=3C$$

In this case, the upper 4-bits are discarded and 'C' of lower 4-bits is taken as the check sum.

$$\text{Or, } 4+B+5+A=1E$$

In this case, the upper 4-bits are discarded and 'E' of lower 4-bits can be taken as the check sum.

Figure 4A:
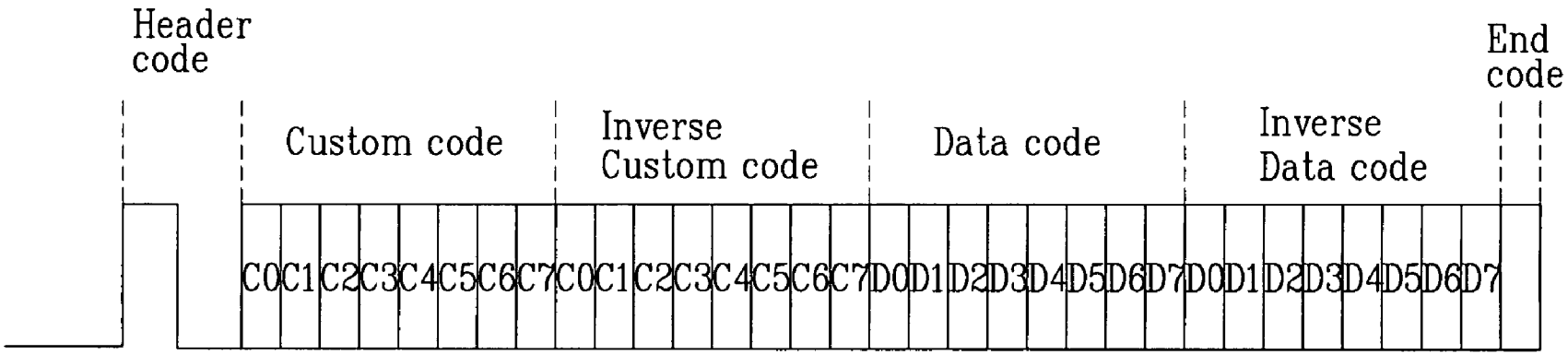
FIGS. 4A to 4D are diagrams of a remote controller code format structure according to another embodiment of the invention.

FIGS. 4A to 4D are diagrams of a remote controller code format structure according to another embodiment of the invention. FIG. 4A shows one frame of a remote controller code format.

Referring to FIG. 4A, a header code, a custom code, an inverse custom code, a data code, and an inverse data code are sequentially arranged. An end code may be further arranged next to the inverse data code. In this embodiment, 8-bits are allocated to each of the custom, inverse custom, data, and inverse data codes, and 1-bit is allocated to the end code.

Figure 4B:
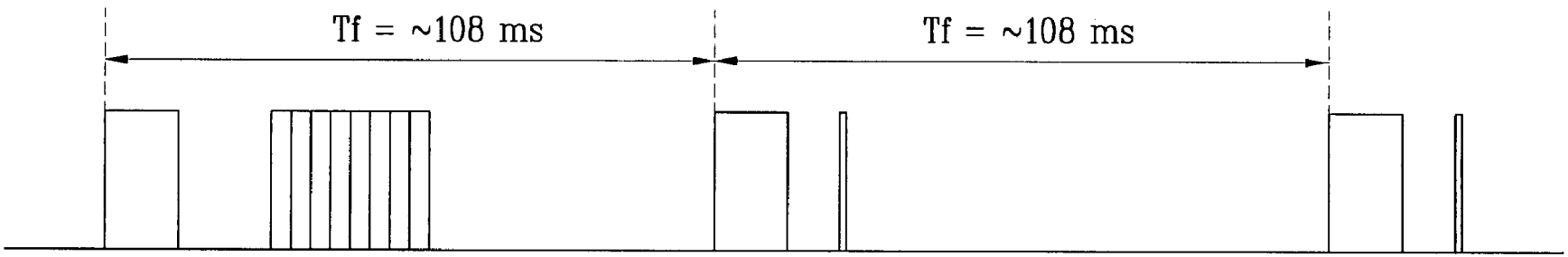

FIG. 4B shows a length ($T_f$) of one frame of a remote controller code format of FIG. 4A. Referring to FIG. 4B, in this embodiment, a length of one frame is set up to ~108 ms.

Figure 4C:
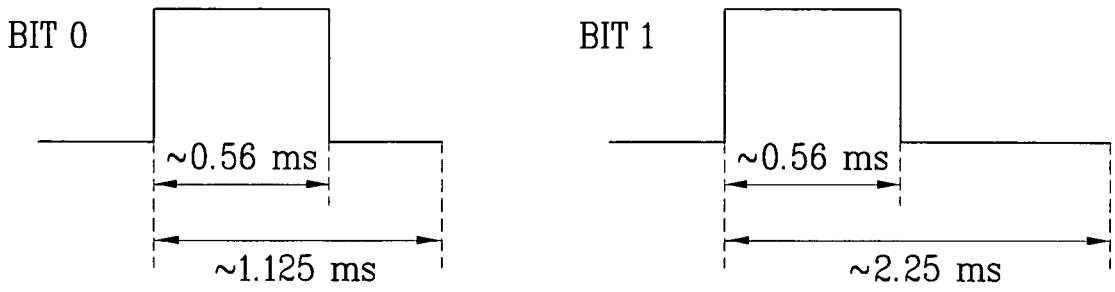

FIG. 4C shows a length of bit-0 and a length of bit-1. Referring to FIG. 4C, in bit-0, a length of a high pulse is set up to ~0.56 ms and a total length of high and low pulses is set up to ~1.125 ms. In bit-1, a length of a high pulse is set up to ~0.56 ms and a total length of high and low pulses is set up to ~2.25 ms.

Figure 4D:
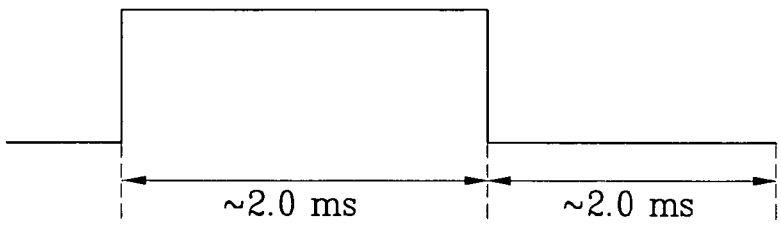

FIG. 4D shows a length of the header code of FIG. 4A. Referring to FIG. 4D, in this embodiment, the header code includes a signal pulse of one cycle. Further, a high pulse length is equal to a low pulse length. Also, in this embodiment, the high pulse length is set up to ~2 ms and the low pulse length is set up to ~2 ms.

The remote controller code format structure of FIGS. 4A-4D equalize the lengths of the high and low pulses of the header code. Further, it can be programmed to enable an operation within an error range between ±~0.5 ms.

The system of transmitting/receiving the remote controller code format according to embodiments of the invention includes a remote controller and a receiver. The remote controller outputs a control signal to the receiver to be controlled and the receiver performs a function according to the control signal of the remote controller.

The remote controller stores a plurality of remote controller code format modes, sets up one of the stored remote controller code formats, and transmits the control signal according to the setup remote controller code format. Further, the receiver stores information of a plurality of remote controller code formats, analyzes the control signal transmitted from the remote controller according to the stored information, and performs the function according to the analyzed control signal.

The plurality of the remote controller code formats may correspond to the remote controller code formats discussed above with respect to embodiments of the invention. That is, the first mode may be a remote controller code format having an arrangement sequence of a header code, a custom code, a data code, an inverse data code, an inverse custom code, and an end code. The second mode may be a remote controller code format having an arrangement sequence of a header code, a custom code, an inverse custom code, a data code, an inverse data code, a check sum code, and an end code. The third mode may be a remote controller code format having an arrangement sequence of a header code, a custom code, an inverse custom code, a data code, an inverse data code, and an end code.

Each of the header codes of the first and second modes may be configured with a signal pulse of one cycle, in which a high pulse length is set at least twice longer than a low pulse length. The header code of the third mode may be configured with a signal pulse of one cycle, in which a high pulse length is equal to a low pulse length.

Figure 5A:
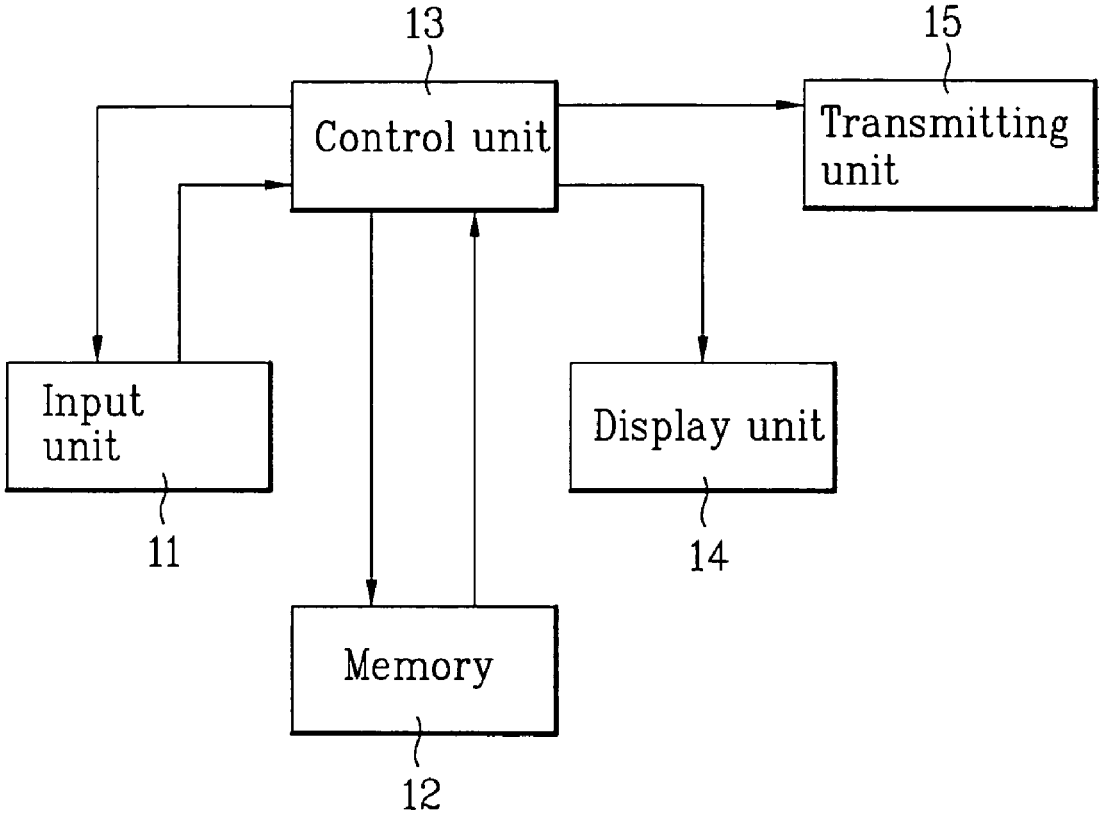
FIG. 5A is a block diagram of a remote controller having a display according to an embodiment of the invention.
Figure 5B:
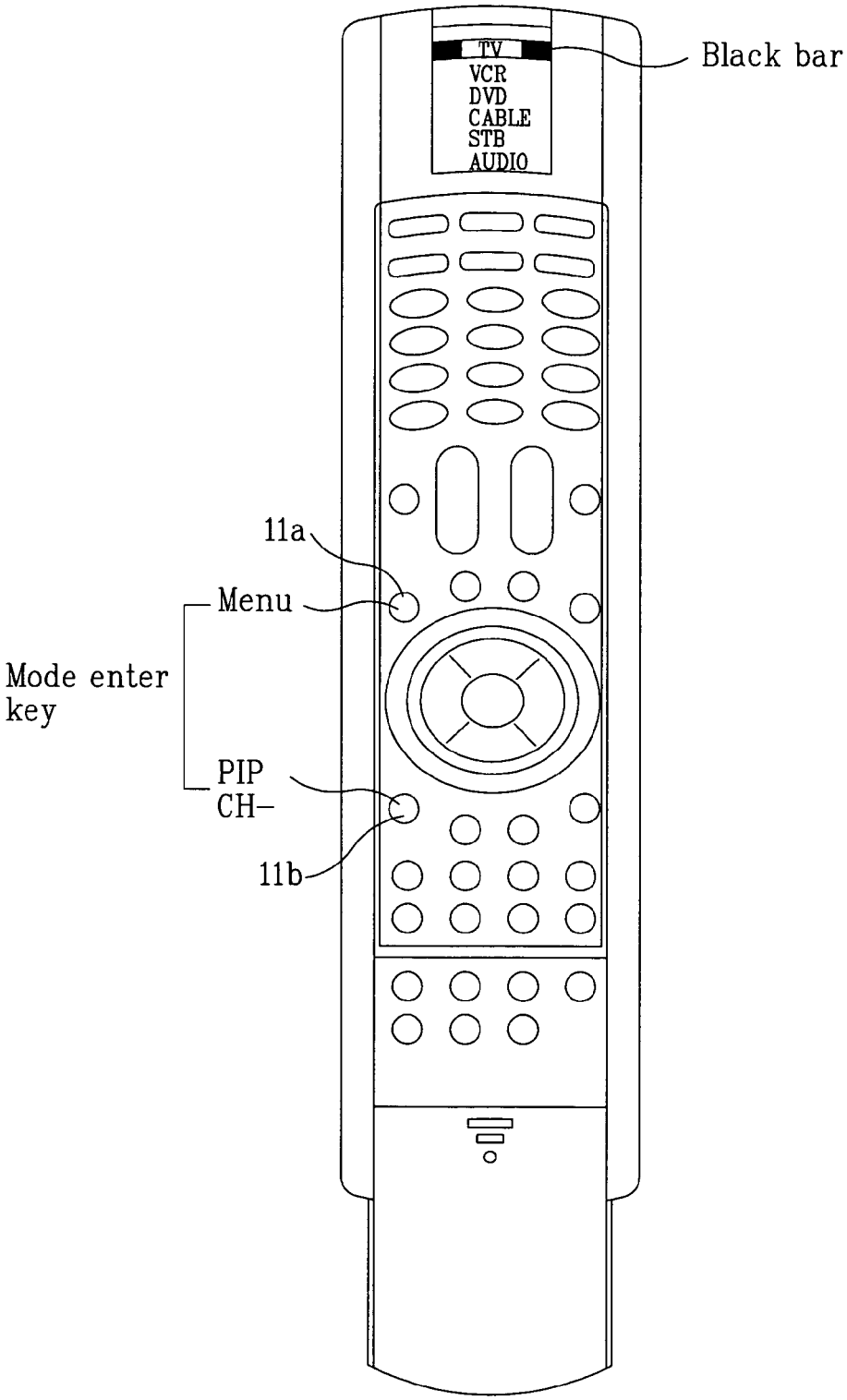
FIG. 5B is a schematic front view of a remote controller having a display according to an embodiment of the invention.

FIG. 5A is a block diagram of a remote controller having a display according to an embodiment of the invention and FIG. 5B is a schematic front view of a remote controller having a display according to an embodiment of the invention. Referring to FIG. 5A, a remote controller according to an embodiment of the invention may include an input unit 11, such as a key input unit, a memory 12, a control unit 13, a display unit 14, and a transmitting unit 15. The input unit 11 receives a signal and the memory 12 stores a plurality of remote controller code format modes.

Referring to FIG. 5B, where the input unit 11 is a key input unit, the input unit 11 may include a mode enter key for setting up the remote controller code format mode and keys for controlling a receiver. The mode enter key may be a dual key configured with a pair of keys that are simultaneously pressed to enter a mode for setting up the remote controller code format mode. For example, a dual key, such as that shown in FIG. 5B, can enter the mode for setting up the remote controller code format mode by pressing a menu key 11*a* and a channel key 11*b* of the input unit simultaneously.

The control unit 13 may select a receiver to be controlled according to the signal of the input unit 11, set up the remote controller code format mode for the selected receiver, and extract the setup remote controller code format mode from the memory 12, to generate a control signal according to the extracted remote controller code format mode. The display unit 14 may display a list of receivers to be controlled and a presence or non-presence of setup completion of the remote controller code format mode, and the transmitting unit 15 may transmit the control signal generated from the control unit 13. The display unit 14, as shown in FIG. 5B, may inform a user of setup completion of the remote controller code format mode, for example, by displaying a black bar that flickers, for example, three times, on an item of the receiver to be controlled.

A method of transmitting a control signal of a remote controller having a display such as that shown above in accordance with an embodiment of the invention is explained as follows.

Figure 6:
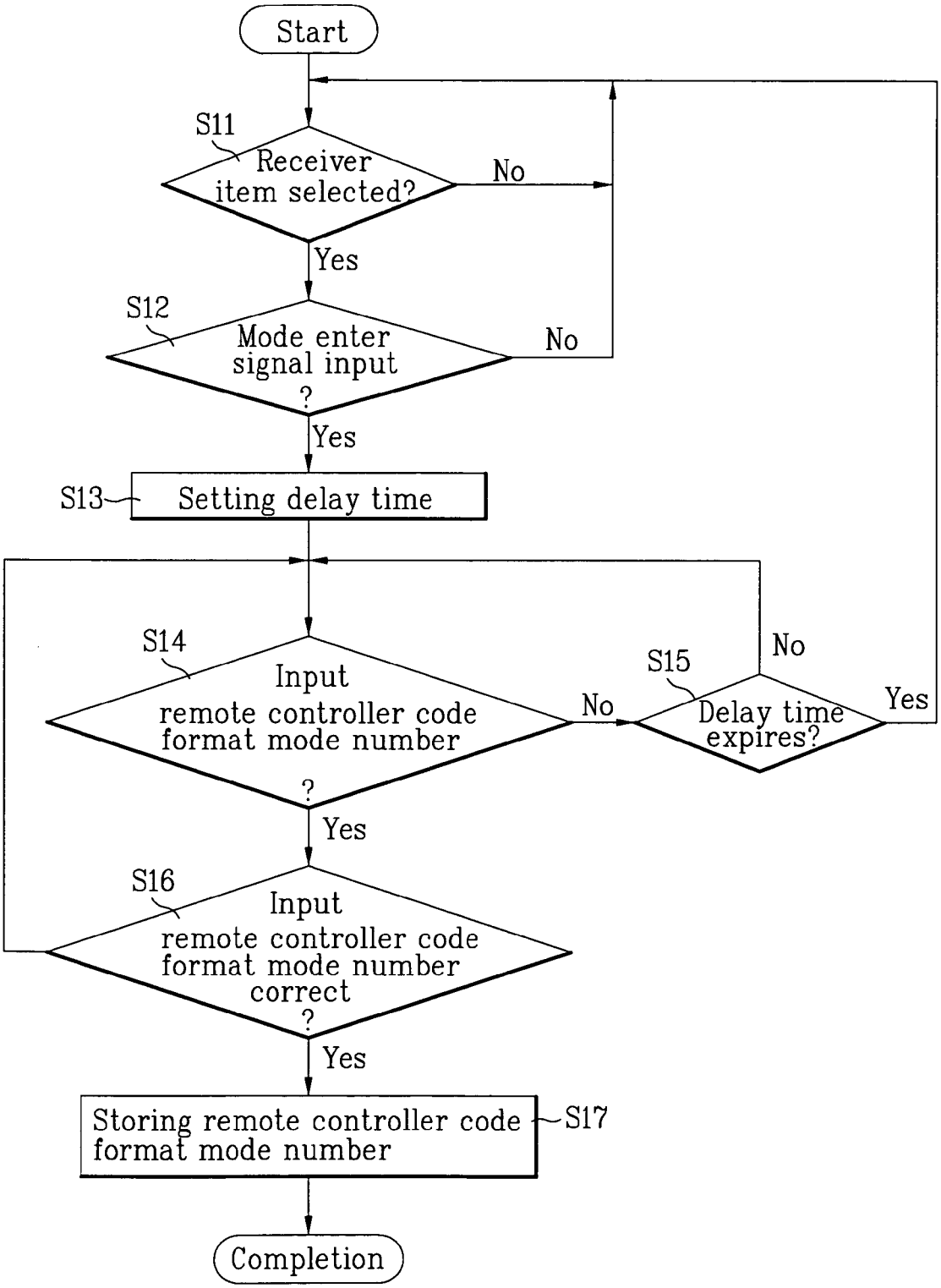
FIG. 6 is a flowchart of a remote controller code format setup of a remote controller having a display according to an embodiment of the invention.

FIG. 6 is a flowchart of a remote controller code format setup of a remote controller having a display in accordance with an embodiment of the invention. Referring to FIG. 6, a control unit decides whether an item for a receiver to be controlled has been selected, in step S11. Namely, the item of the receiver to be controlled is selected among receiver items, such as TV, VCR, DVD, CABLE, STB, AUDIO, etc. listed on a display unit. If an item of the receiver is not selected, the step S11 of deciding whether an item of the receiver to be controlled is selected is repeatedly executed.

Subsequently, if the item of the receiver is selected, the control unit decides whether a mode enter signal for a remote controller code format mode setup is input, in step S12. If the mode enter signal is input, the control unit sets a delay time for inputting a remote controller code format mode number to be set, in step S13. If the mode enter signal is not input, the step S11 of deciding whether the item of the receiver to be controlled is selected is repeated.

If the delay time is set, the control unit decides whether the remote controller code format mode number is input, in step S14. If the remote controller code format mode number is input, the control unit checks whether the input remote controller code format mode number is correct, in step S16. The display unit repeatedly flickers a black bar on the item of the receiver corresponding to the input remote controller code format mode number with, for example, about an 0.5 sec interval.

Subsequently, if the input remote controller code format mode number is correct, the control unit stores the input remote controller code format mode number in a memory, in step S17, and the display unit flickers the black bar on the item of the receiver corresponding to the input remote controller code format mode number, for example, three times, with, for example, about an 0.5 sec interval. If the input remote controller code format mode number is incorrect, the control unit repeatedly executes the step S14 of deciding whether the remote controller code format mode number is input.

Meanwhile, in step S14 of deciding whether the remote controller code format mode number is input, if the remote controller code format mode number is not input, the control unit checks whether the set delay time expires, in step S15. If the set delay time expires, the control unit repeats step S11 of deciding whether the item of the receiver to be controlled is selected. If the set delay time fails to expire, the control unit repeats step S14 of deciding whether the remote controller code format mode number is input.

Thus, if a remote controller code format mode is set up, the control unit generates the control signal according to the set remote controller code format mode if the signal is input. The control unit then transmits the generated control signal to the receiver to be controlled.

Figure 7A:
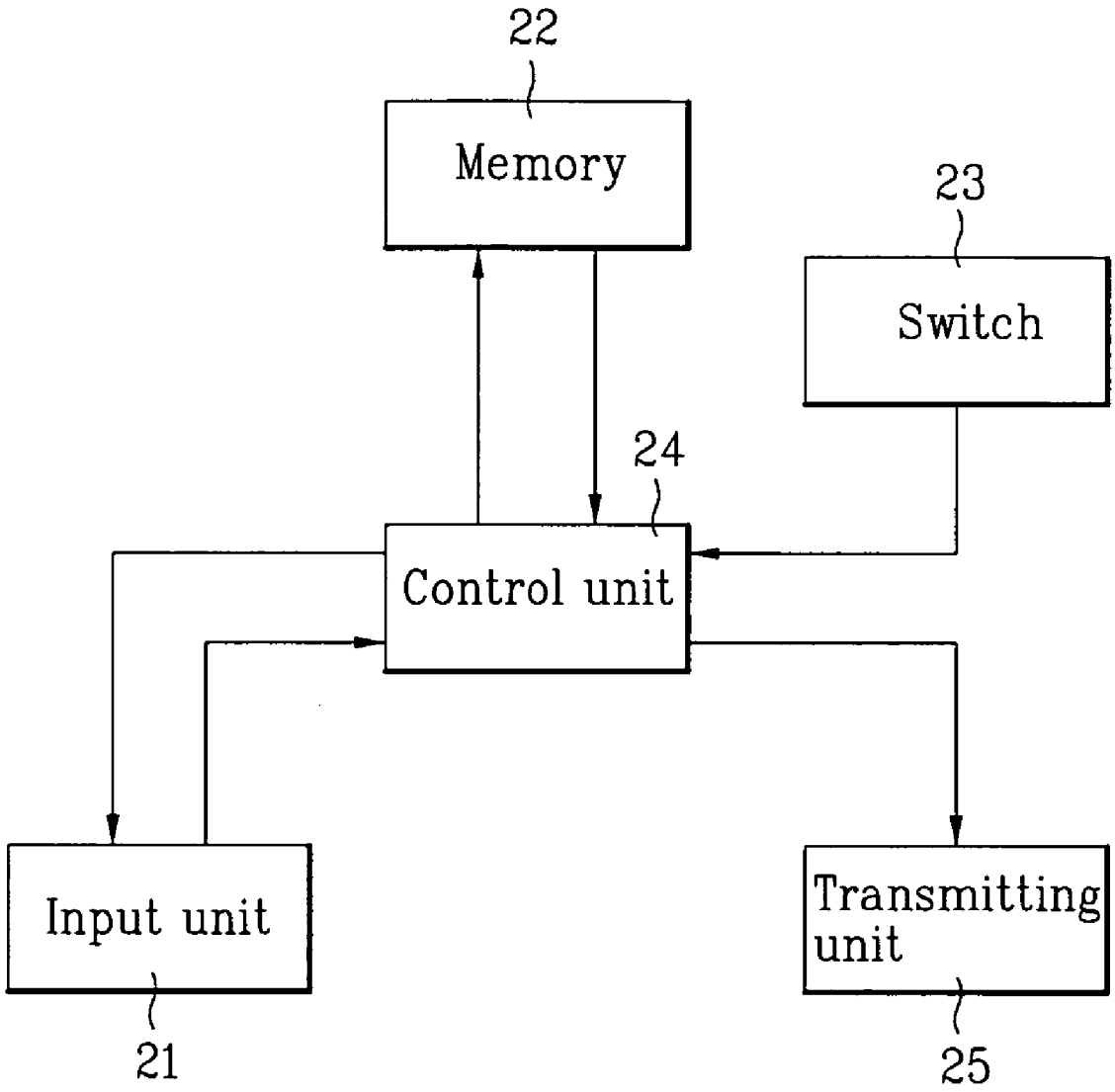
FIG. 7A is a block diagram of a remote controller having no display according to an embodiment of the invention.
Figure 7B:
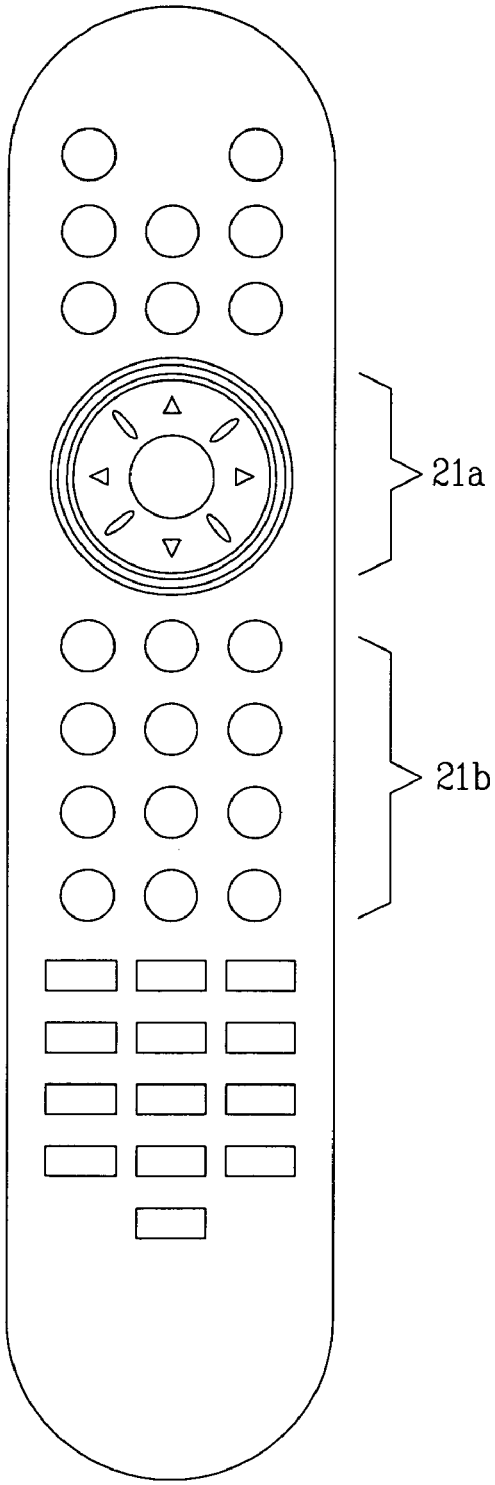
FIG. 7B is a schematic front view of a remote controller having no display according to an embodiment of the invention.
Figure 7C:
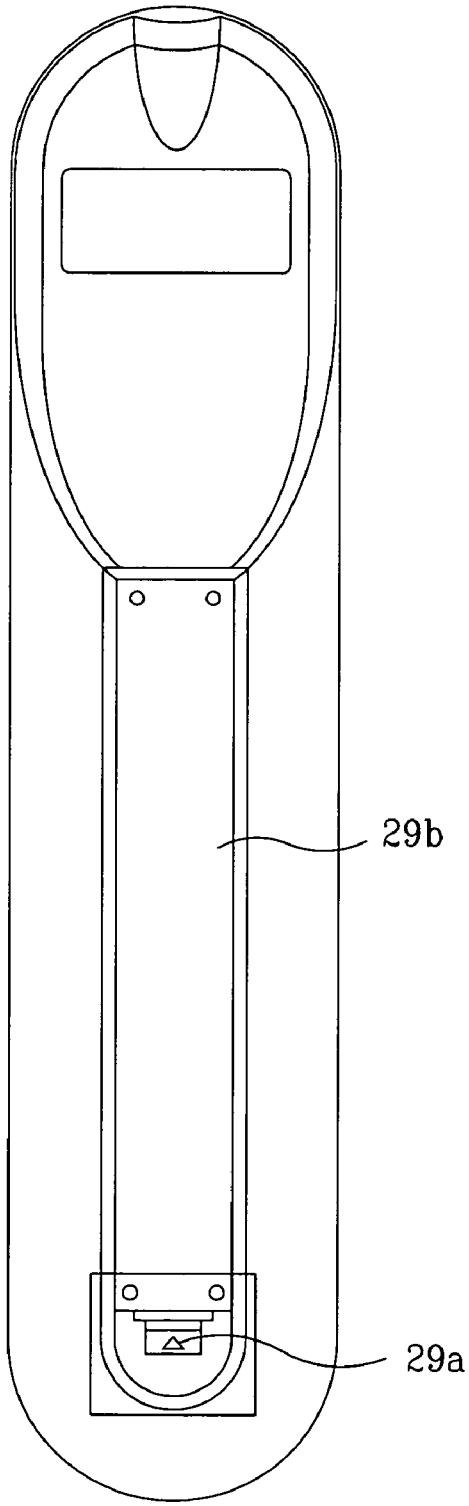
FIG. 7C is a schematic rear view of a remote controller having no display according to an embodiment of the invention.

FIG. 7A is a block diagram of a remote controller having no display according to an embodiment of the invention. FIG. 7B is a schematic front view of a remote controller having no display according to an embodiment of the invention. FIG. 7C is a rear diagram of a remote controller having no display according to an embodiment of the invention.

Referring to FIG. 7A, a remote controller having no display according to an embodiment of the invention may include an input unit 21, such as a key input unit, a memory 22, a switch 23, a control unit 24, and a transmitting unit 25. The input unit 21 receives a signal and the memory stores the plurality of remote controller code format modes therein. The switch selects one of the plurality of the remote controller code format modes. The switch 23, as shown in FIG. 7C, may be, for example, a push switch 29*a* situated on a battery cover 29*b* of the remote controller.

The control unit 24 extracts the selected remote controller code format mode from the memory 22 and generates a control signal according to the extracted remote controller code format mode. The transmitting unit 25 then transmits the generated control signal.

Figure 8:
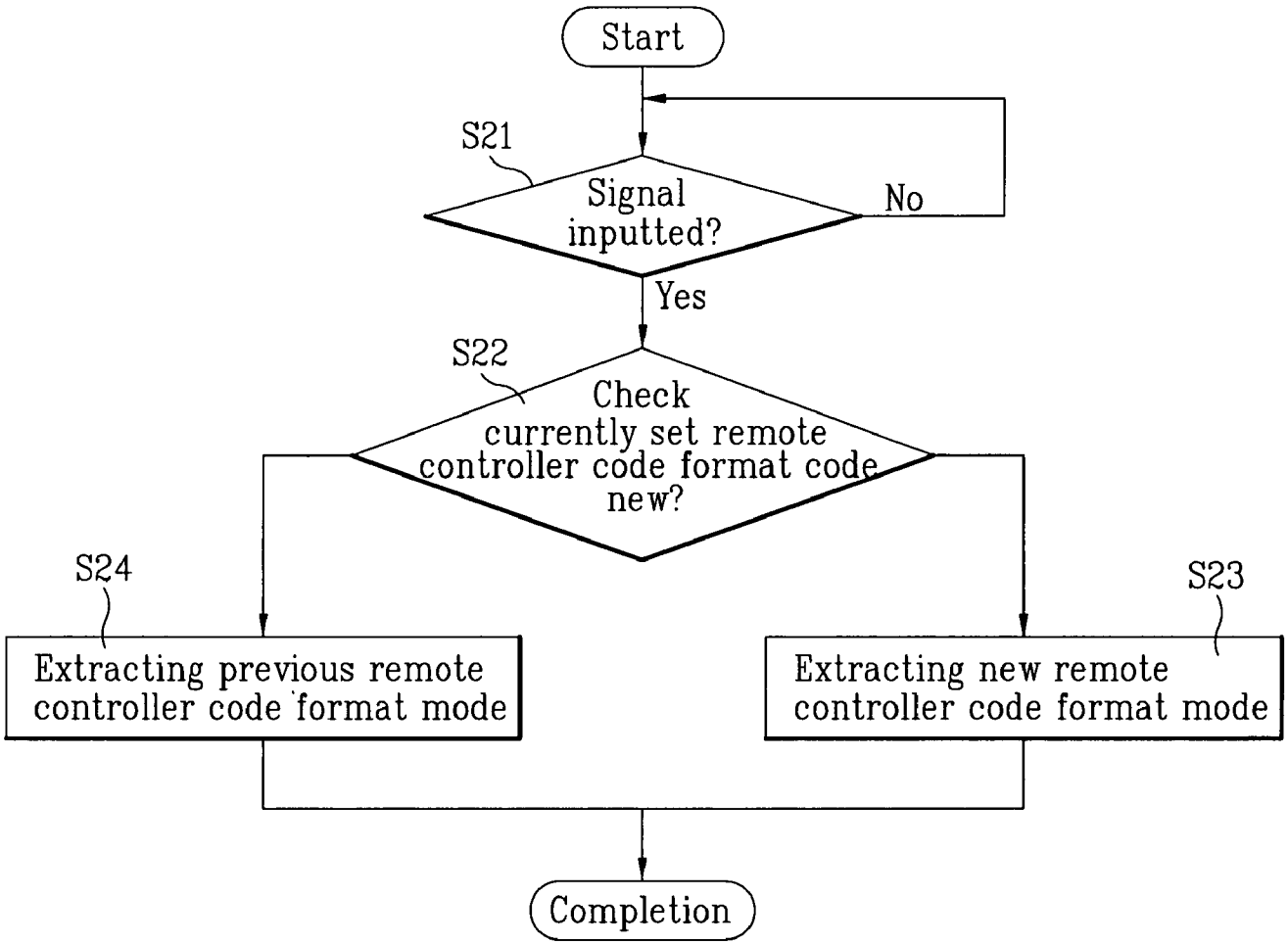
FIG. 8 is a flowchart of a remote controller code format setup of a remote controller having no display according to an embodiment of the invention.

FIG. 8 is a flowchart of a remote controller code format setup method of a remote controller having no display in accordance with an embodiment of the invention. Referring to FIG. 8, a control unit decides whether a signal of a remote controller is input, in step S21. If the signal of the remote controller is input, the control unit checks a currently set remote controller code format mode, in step S22. If the signal of the remote controller is not input, step S21 of deciding whether the signal of the remote controller is input is repeated.

If the control unit decides that the currently set remote controller code format mode is a new remote controller code format mode, the new remote controller code format mode is extracted from a memory, in step S23. If the control unit decides that the currently set remote controller code format mode is a previous remote controller code format mode, the previous remote controller code format mode is extracted from the memory, in step S24. Thus, once the remote controller code format mode is extracted, the control unit generates a control signal according to the extracted remote controller code format mode and then transmits the generated control signal to a receiver to be controlled.

The remote controller code format transmitted in the above-explained manner is received by the receiver in the following manner. First, the receiver receives the control signal from the remote controller and then checks for the presence or non-presence of errors regarding the control signal by analyzing the received control signal. If the control signal is free from error, the receiver performs a function corresponding to the analyzed control signal. If the control signal is erroneous, the analysis of the control signal is terminated.

Figure 9:
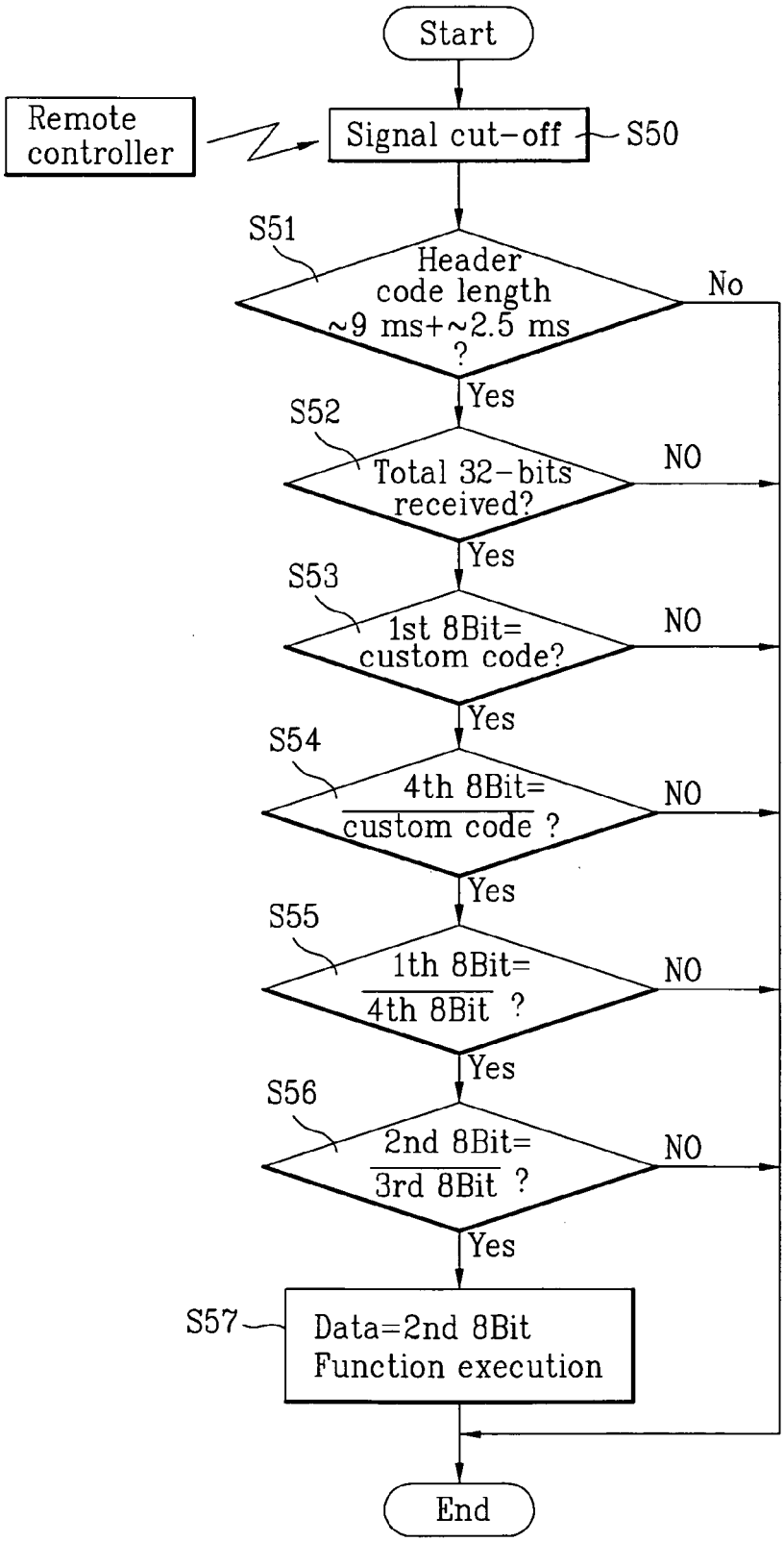
FIG. 9 is a flowchart of a reception method for analyzing a control signal received according to a first mode from a remote controller according to an embodiment of the invention.

FIG. 9 is a flowchart of a reception method according to an embodiment of the invention, for analyzing a control signal received from a remote controller in a remote control code format according to a first embodiment as discussed above. Referring to FIG. 9, a control unit of a receiver cuts off signals following an initially received control signal, in step S50. The control unit then decides whether a length of a header code in the received control signal is a predefined length, in step S52. If the length of the header code is the predefined length, the control unit decides whether a total bit number of first to fourth codes is a predefined bit number, in step S53.

In this embodiment, it is assumed that the predefined length of the header code is set up to a high pulse length of ~9 ms and a low pulse length of ~2.25 ms and that a predefined total bit number is 32-bits. Subsequently, if the total bit number meets the predefined bit number, the control unit decides whether the first code is a custom code, in step S53. If the first code is the custom code, the control unit decides whether the fourth code is an inverse custom code, in step S54.

If the fourth code is the inverse custom code, the control unit decides whether a first bit number is equal to a fourth bit number, in step S55. If the bit numbers are equal to each other, the control unit decides whether a second bit number is equal to a third bit number, in step S56. If the bit numbers are the same, the control unit performs a function according to a data code as the second code, in step S57.

Figure 10:
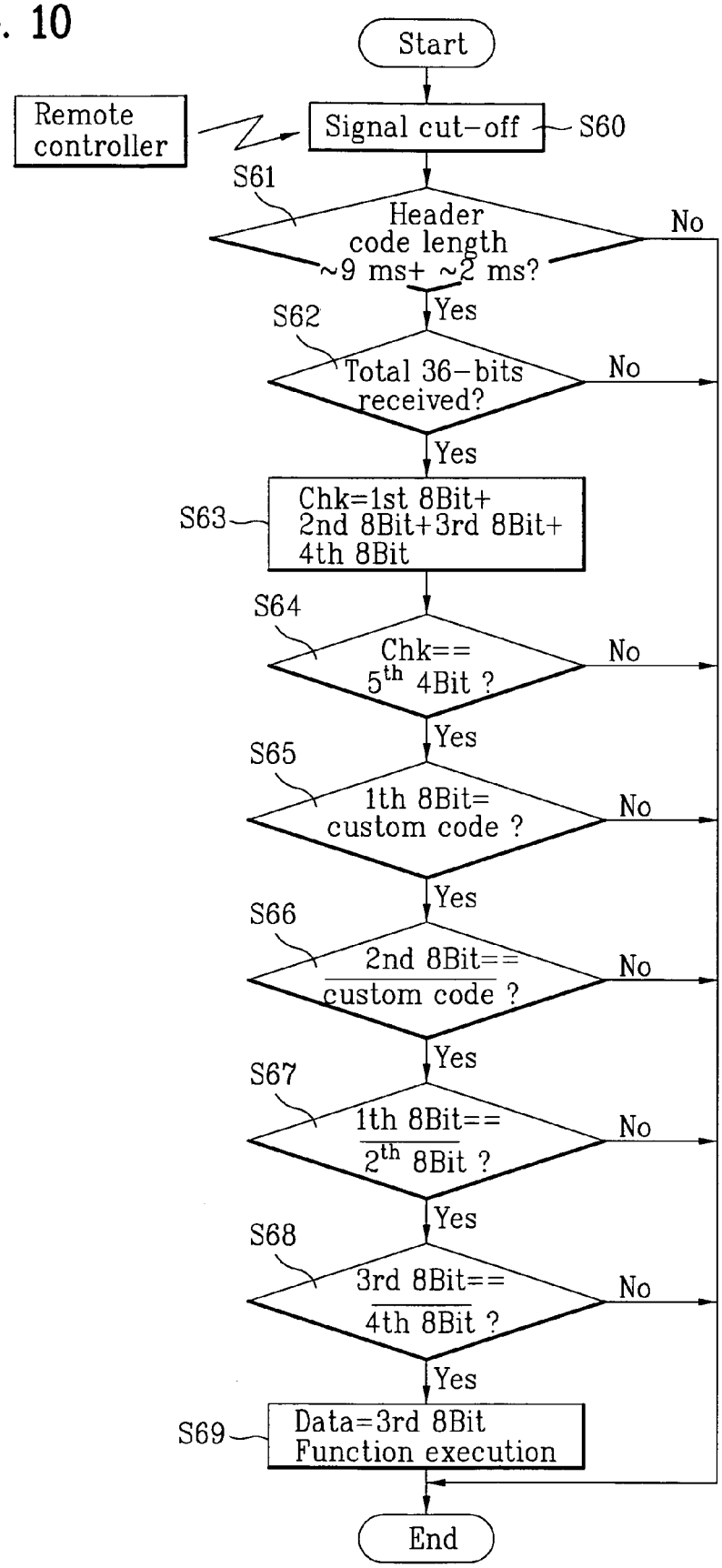
FIG. 10 is a flowchart of a reception method for analyzing a control signal received according to a second mode from a remote controller according to an embodiment of the invention.

FIG. 10 is a flowchart of a reception method according to another embodiment of the invention, for analyzing a control signal received from a remote controller in a remote control code format according to a second embodiment as discussed above. Referring to FIG. 10, a control unit of a receiver cuts off signals following an initially received control signal, in step S60. The control unit then decides whether a length of a header code in the received control signal is a predefined length, in step S61. If the length of the header code is the predefined length, the control unit decides whether a total bit number of first to fifth codes is a predefined bit number, in step S62. In this embodiment, it is assumed that the predefined length of the header code is set up to a high pulse length of ~9 ms and a low pulse length of ~2.25 ms and that a predefined total bit number is 36-bits.

Subsequently, if the total bit number meets the predefined bit number, the control unit decides whether each bit number of the first to fifth codes is a predefined bit number code, in step S63, and decides whether the fifth code is a check sum code, in step S64. If the fifth code is the check sum code, the control unit decides whether the first code is a custom code, in step S65. If the first code is the custom code, the control unit decides whether the second code is an inverse custom code, in step S66. If the second code is the inverse custom code, the control unit decides whether a first bit number is equal to a second bit number, in step S67. If the bit numbers are equal to each other, the control unit decides whether a third bit number is equal to a fourth bit number, in step S68. If the bit numbers are the same, the control unit performs a function according to a data code that is the third code, in step S69.

Figure 11:
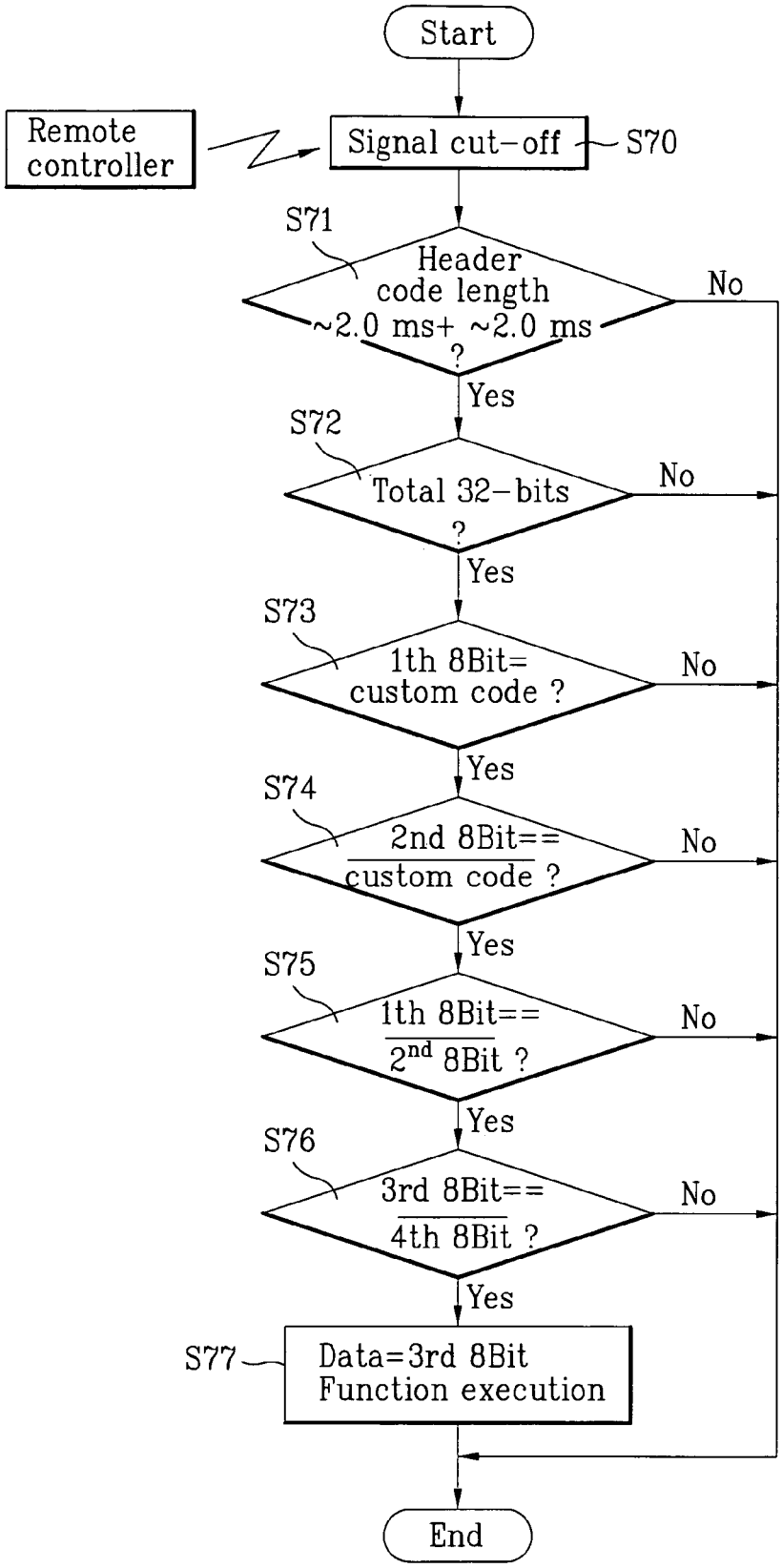
FIG. 11 is a flowchart of a reception method for analyzing a control signal received according to a third mode from a remote controller according to an embodiment of the invention.

FIG. 11 is a flowchart of a reception method according to another embodiment of the invention, for analyzing a control signal received from a remote controller in a remote control code format according to a third embodiment as discussed above. Referring to FIG. 11, a control unit of a receiver cuts off signals following an initially received control signal, in step S70. The control unit then decides whether a length of a header code in the received control signal is a predefined length, in step S71. In this embodiment, it is assumed that the predefined length of the header code is set up to a high pulse length of ~2 ms and a low pulse length of ~2 ms and that a predefined total bit number is 32-bits.

If the length of the header code is the predefined length, the control unit decides whether a total bit number of first to fourth codes is a predefined bit number, in step S72. If the total bit number meets the predefined bit number, the control unit decides whether the first code is a custom code, in step S73. If the first code is the custom code, the control unit decides whether the second code is an inverse custom code, in step S74. If the fourth code is the inverse custom code, the control unit decides whether a first bit number is equal to a second bit number, in step S75.

If the bit numbers are equal to each other, the control unit decides whether a third bit number is equal to a fourth bit number, in step S76. If the bit numbers are the same, the control unit performs a function according to a data code that is the third code, in step S77.

The terminologies used in the description of embodiments of the invention are defined to take the functions in the invention into consideration and may vary according to intentions or conventions of those skilled in the art. Hence, the definitions of the terminologies should be made based on the overall contents of embodiments of the invention.

Accordingly, with the remote controller code format(s), transmitting/receiving apparatus thereof, and transmitting/receiving method(s) thereof according to embodiments of the invention, data can be transmitted/received using an intrinsic remote controller code format to prevent reciprocal compatibility with another remote controller of a different manufacturer. Data can be transmitted/received by selecting one of various code formats.

The foregoing embodiments and advantages are merely exemplary and are not to be construed as limiting the invention. The present teaching can be readily applied to other types of apparatuses. The description of the invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A remote controller system, comprising:

a remote controller configured to store a plurality of remote controller code format modes therein, to set up one of the stored plurality of remote controller code format modes as a transmission mode, to generate a control signal according to the set up remote controller code format mode, and to transmit the generated control signal; and a receiver configured to store information for the plurality of the remote controller code format modes therein and analyze the control signal transmitted from the remote controller according to the stored information, wherein the remote controller is configured to:

decide whether an item of the receiver to be controlled is selected, if the item of the receiver is selected, decide whether a mode enter signal for setting up the remote controller code format mode is input, if the mode enter signal is input, set a delay time for inputting a remote controller code format mode number, if the delay time is set, decide whether the remote controller code format mode number is input, if the remote controller code format number is input, check whether the input remote controller code format mode number is correct, and if the remote controller code format is correct, store the input remote controller code format mode number.

2. The system of claim 1, wherein the remote controller comprises:

an input unit configured to receive a signal input;

a memory configured to store the plurality of the remote control code format modes therein;

a switch for selecting one of the plurality of remote control code format modes;

a control unit configured to extract the selected remote control code format mode from the memory to generate a control signal according to the extracted remote control code format mode; and a transmitting unit configured to transmit the generated control signal.

3. The system of claim 1, wherein the remote controller comprises:

an input unit configured to receive a signal input;

a memory configured to store the plurality of the remote control code format modes therein;

a control unit configured to select the receiver to be controlled according to a signal of the input unit, to set up the remote control code format mode for the selected receiver, and to extract the set-up remote control code format mode from the memory to generate a control signal according to the extracted remote control code format mode;

a display unit configured to display a list of the receiver to be controlled and a presence or non-presence of a setup completion of the remote control code format mode; and a transmitting unit configured to transmit the generated control signal.

4. The system of claim 3, wherein the key input unit comprises a mode enter key for setting up the remote control code format mode and a plurality of keys for controlling the receiver.

5. The system of claim 4, wherein the mode enter key is a dual key comprising a pair of keys, and wherein the pair of the keys are pressed to enter a mode for setting up the remote control code format mode.

6. The system of claim 1, wherein the remote controller code format modes comprise at least a first mode, a second mode and a third mode.

7. The system of claim 6, wherein the first mode comprises a remote controller code format arranged in a sequence of a header code, a custom code, a data code, an inverse data code, an inverse custom code, and an end code.

8. The system of claim 6, wherein the second mode comprises a remote controller code format arranged in a sequence of a header code, a custom code, an inverse custom code, a data code, an inverse data code, a check sum code, and an end code.

9. The system of claim 6, wherein the third mode comprises a remote controller code format arranged in a sequence of a header code, a custom code, an inverse custom code, a data code, an inverse data code, and an end code.

10. A remote controller code format transmitting method for a remote controller system including a remote controller and a receiver remotely controlled by the remote controller, the method comprising:

setting up one of a plurality of remote controller code format modes;

generating a control signal according to the set-up remote controller code format mode; and transmitting the generated control signal to the receiver to be controlled, wherein setting up one of a plurality of remote controller code format modes comprises:

deciding whether an item of the receiver to be controlled is selected, if the item of the receiver is selected, deciding whether a mode enter signal for setting up the remote controller code format mode is input, if the mode enter signal is input, setting a delay time for inputting a remote controller code format mode number, if the delay time is set, deciding whether the remote controller code format mode number is input, if the remote controller code format number is input, checking whether the input remote controller code format mode number is correct, and if the remote controller code format is correct, storing the input remote controller code format mode number.

11. The method of claim 10, wherein deciding whether the item of the receiver to be controlled is selected comprises: if the item of the receiver is not selected, repeating the deciding whether the item of the receiver to be controlled is selected.

12. The method of claim 10, wherein deciding whether the mode enter signal for setting up the remote controller code format mode is input comprises: if the mode enter signal is not input, repeating the deciding whether the item of the receiver to be controlled is selected.

13. The method of claim 12, wherein setting up one of a plurality of remote controller code format modes comprises:

deciding whether a signal of the remote controller is input;

if the signal of the remote controller is input, checking a currently set-up remote controller code format mode; and extracting a new remote controller code format mode if the currently set-up remote controller code format mode is the new remote controller code format mode or a previous remote controller code format mode if the currently set-up remote controller code format mode is the previous remote controller code format mode.

14. The method of claim 13, wherein deciding whether the signal of the remote controller is input comprises:

if the signal of the remote controller is not input, repeating the deciding whether the signal of the remote controller is input.

15. The method of claim 10, wherein deciding whether the remote controller code format mode number is input, comprises:

if the remote controller code format mode number is not input, checking whether the set delay time expires; and if the set delay time expires, repeating the deciding whether the item of the receiver to be controlled is selected.

16. The method of claim 15, wherein deciding whether the set delay time expires comprises: if the set delay time fails to expire, repeating the deciding whether the remote controller code format mode number is input.

17. The method of claim 15, wherein checking whether the input remote controller code format mode number is correct comprises: if the input remote controller code format mode number is incorrect, repeating the deciding whether the remote controller code format mode number is input.

18. A remote controller code format receiving method for a remote controller system including a remote controller and a receiver remotely controlled by the remote controller, the method comprising:

receiving a control signal from the remote controller;

checking whether the control signal is erroneous by analyzing the received control signal; and if the control signal is not erroneous, performing a corresponding function according to the analyzed control signal, wherein checking whether the control signal is erroneous comprises:

cutting off signals following an initially received control signal, deciding whether a length of a header code is a predefined length in the received control signal, if the length of the header code is the predefined length, deciding whether a total bit number of first to fourth codes is a predefined bit number, if the total bit number is the predefined bit number, deciding whether the first code is a custom code, if the first code is the custom code, deciding whether the second code is an inverse custom code, if the second code is the inverse custom code, deciding whether a first bit number is equal to a second bit number, if the first bit number is equal to the second bit number, deciding whether a third bit number is equal to a fourth bit number, and if the third bit number is equal to the fourth bit number, performing the function according to a data code that is the third code.

* * * * *